US007554022B2

(12) United States Patent
Matsubara

(10) Patent No.: US 7,554,022 B2
(45) Date of Patent: Jun. 30, 2009

(54) STRINGED INSTRUMENT BRIDGE

(75) Inventor: Akifumi Matsubara, Nagoya (JP)

(73) Assignee: Hoshino Gakki Co., Ltd. (JP)

( * ) Notice: Subject to any disclaimer, the term of this patent is extended or adjusted under 35 U.S.C. 154(b) by 40 days.

(21) Appl. No.: 11/464,229

(22) Filed: Aug. 14, 2006

(65) Prior Publication Data

US 2008/0034939 A1 Feb. 14, 2008

(51) Int. Cl.
*G10D 3/04* (2006.01)

(52) U.S. Cl. ..... 84/298; 84/290

(58) Field of Classification Search ..... 84/298, 84/290, 299, 313
See application file for complete search history.

(56) References Cited

U.S. PATENT DOCUMENTS 3,605,545 A 9/1971 Rendell ..... 84/307
4,860,628 A * 8/1989 Storey ..... 84/313
4,911,057 A 3/1990 Fishman ..... 84/731
5,109,747 A 5/1992 Spuler ..... 84/731
5,153,363 A 10/1992 Fishman et al. ..... 84/731
6,818,814 B2 * 11/2004 Park ..... 84/298

* cited by examiner

*Primary Examiner*—Jeffrey Donels
*Assistant Examiner*—Jianchun Qin
(74) *Attorney, Agent, or Firm*—Ostrolenk, Faber, Gerb & Soffen, LLP

(57) ABSTRACT

A bridge for an acoustic guitar including a body and a neck extending outward from the body. The bridge includes a base fixed to the body, and a saddle support for supporting a saddle. The saddle support has a support surface for supporting a side surface of the saddle that is closer to the neck. The saddle is supported with its upper surface protruding from an upper surface of the saddle support. The saddle support has a plurality of grooves extending in the direction of the corresponding strings. The strings are supported by the upper surface of the saddle in the corresponding grooves.

8 Claims, 9 Drawing Sheets

STRINGED INSTRUMENT BRIDGE

BACKGROUND OF THE INVENTION

The present invention relates to a stringed instrument bridge.

A stringed instrument bridge (hereafter, referred to as the "bridge") is used to support strings on the body of a stringed instrument, such as a guitar. For example, as shown in FIG. 14, a bridge 100 is fixed to an upper surface 90*a* of a guitar body 90. A groove 102, which extends in a direction intersecting with the strings 101, is formed on the upper surface 100*a* of the bridge 100. A saddle 103 having a contact surface 103*a* that contacts the strings 101 is fitted in the groove 102. The saddle 103 is supported so that the contact surface 103*a* protrudes from the upper surface 100*a* of the bridge 100. The bridge 100 supports the saddle 103. Further, with the saddle 103, the bridge 100 supports the strings 101 in a manner enabling the strings 101 to vibrate.

Parts of a guitar, such as the body and neck, are mostly made of wood. Since wood desiccates as time elapses from when the guitar is manufactured, warping occurs in parts, such as the neck. The amount of warping gradually increases. As the warping in the guitar parts increase, the height of the strings from the body surface (hereafter, referred to as the "string height") becomes greater than that when the guitar is manufactured. This makes it difficult for a player to press the strings 101 with the player's fingers when playing the guitar. In such a case, the height of the saddle 103 is adjusted by scraping the end face of the saddle 103 so as to set the height of the strings 101 to a desired height.

For the reasons described above, it is desirable that the saddle 103 be provided with a sufficient height range in order to cope with changes in the height of the strings 101. However, as shown in FIG. 15, if the height of the saddle 103 is increased, unless the saddle 103 is fitted deeper into the groove 102, the upper end of the saddle 103 will be tilted toward the neck (the direction indicated by the arrow T in FIG. 15) by the tension of the strings 101. Such tilting of the saddle 103 will result in unstable supporting of the strings 101 and lower the aesthetic appeal of the guitar. When a pickup is installed under the saddle 103, this may adversely affect conversion of vibrations of the strings 101 into electrical signals.

A stringed instrument bridge providing a means for preventing tilting of the saddle 103 has been proposed. For example, U.S. Pat. No. 3,605,545 discloses a stringed instrument bridge having two ends that are higher than the top of the saddle.

In the case of the stringed instrument bridge described in U.S. Pat. No. 3,605,545, the tilt of the saddle caused by the tension of the strings is prevented at the two ends of the saddle but not at the central portion of the saddle. In other words, the entire saddle cannot be supported uniformly. Thus, the saddle cannot be held in a satisfactory manner.

SUMMARY OF THE INVENTION

It is an object of the present invention to provide a stringed instrument bridge capable of preventing tilting of a saddle while ensuring a sufficient height adjustment range for the saddle.

A first aspect of the present invention is a stringed instrument bridge for supporting a plurality of strings with a saddle on a body of a stringed instrument having a neck, which extends from the body, in a manner enabling vibration of the strings. The stringed instrument bridge includes a base fixed to the body. A saddle support is arranged on the base to support the saddle. A support surface is arranged on the saddle support to support a side surface of the saddle closer to the neck. The saddle is supported in a state in which its upper surface protrudes from an upper surface of the saddle support. The saddle support has a plurality of string insertion portions extending in the direction of the corresponding strings. The strings are supported by the upper surface of the saddle in corresponding string insertion portions.

A second aspect of the present invention is a stringed instrument bridge for supporting a plurality of strings with a saddle on a body of a stringed instrument having a neck, which extends from the body, in a manner enabling vibration of the strings. The stringed instrument bridge includes a base fixed to the body. A saddle support is arranged on the base to support the saddle. A saddle accommodation hole is arranged in the saddle support to accommodate the saddle. The saddle is supported by the saddle support in a state accommodated in the saddle accommodation hole. The saddle support includes a plurality of through holes extending in the direction of the corresponding strings. The saddle accommodation hole intersects the through holes. The strings are supported by the upper surface of the saddle in the corresponding through holes.

DESCRIPTION OF THE PREFERRED EMBODIMENTS

First Embodiment

A stringed instrument bridge according to a first embodiment of the present invention and applied to an acoustic guitar will now be described with reference to FIGS. 1 to 6.

Figure 1:
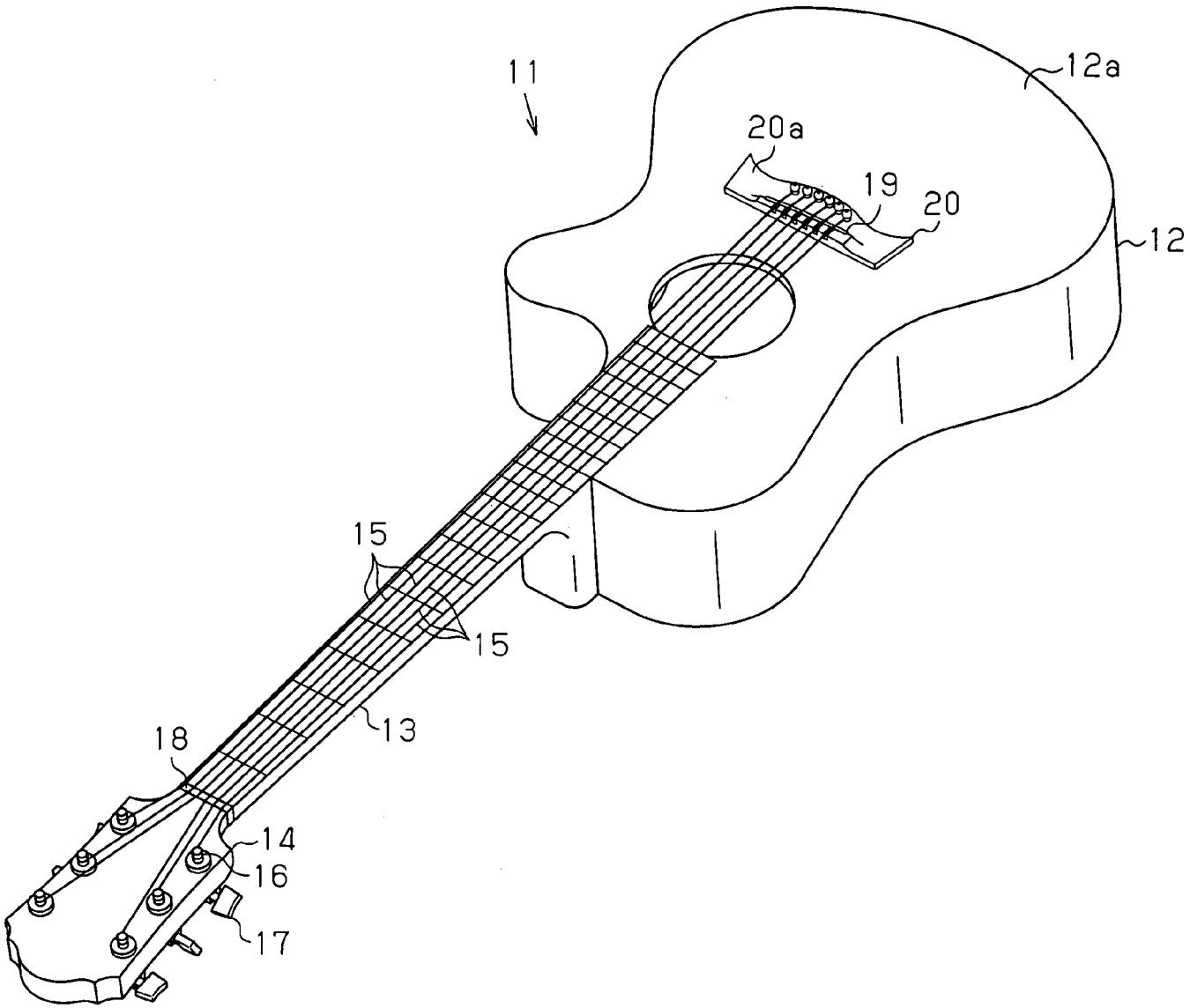
FIG. 1 is a perspective view showing the entire structure of an acoustic guitar.

As shown in FIG. 1, an acoustic guitar (hereafter, referred as the "guitar") 11 has a body 12, a neck 13 extending outward from the body 12, and six strings 15. A head 14 is formed at the distal end of the neck 13. Winding shafts 16 and tuning pegs 17 are attached to the head 14. A nut 18 is arranged at the distal end of the neck 13. The nut 18 supports the strings 15 in a manner enabling vibration of the strings 15 on the neck 13.

A bridge 20 is fixed to the upper surface 12*a* of the body 12. A saddle 19 is supported on an upper surface 20*a* of the bridge 20. The bridge 20 is made of wood such as rosewood. The saddle 19 is made of a material such as ivory, cattle bone, or plastic. The bridge 20, the upper surface 20*a* of which supports the saddle 19, supports the strings 15 with the saddle 19 in a manner enabling the strings 15 to vibrate.

The strings 15 are supported by the saddle 19 and the nut 18 and stretched at a predetermined height from the surfaces of the body 12 and neck 13. The tension of each string 15 is adjusted by turning the corresponding tuning peg 17.

The shape of the bridge 20 will now be discussed.

Figure 2:
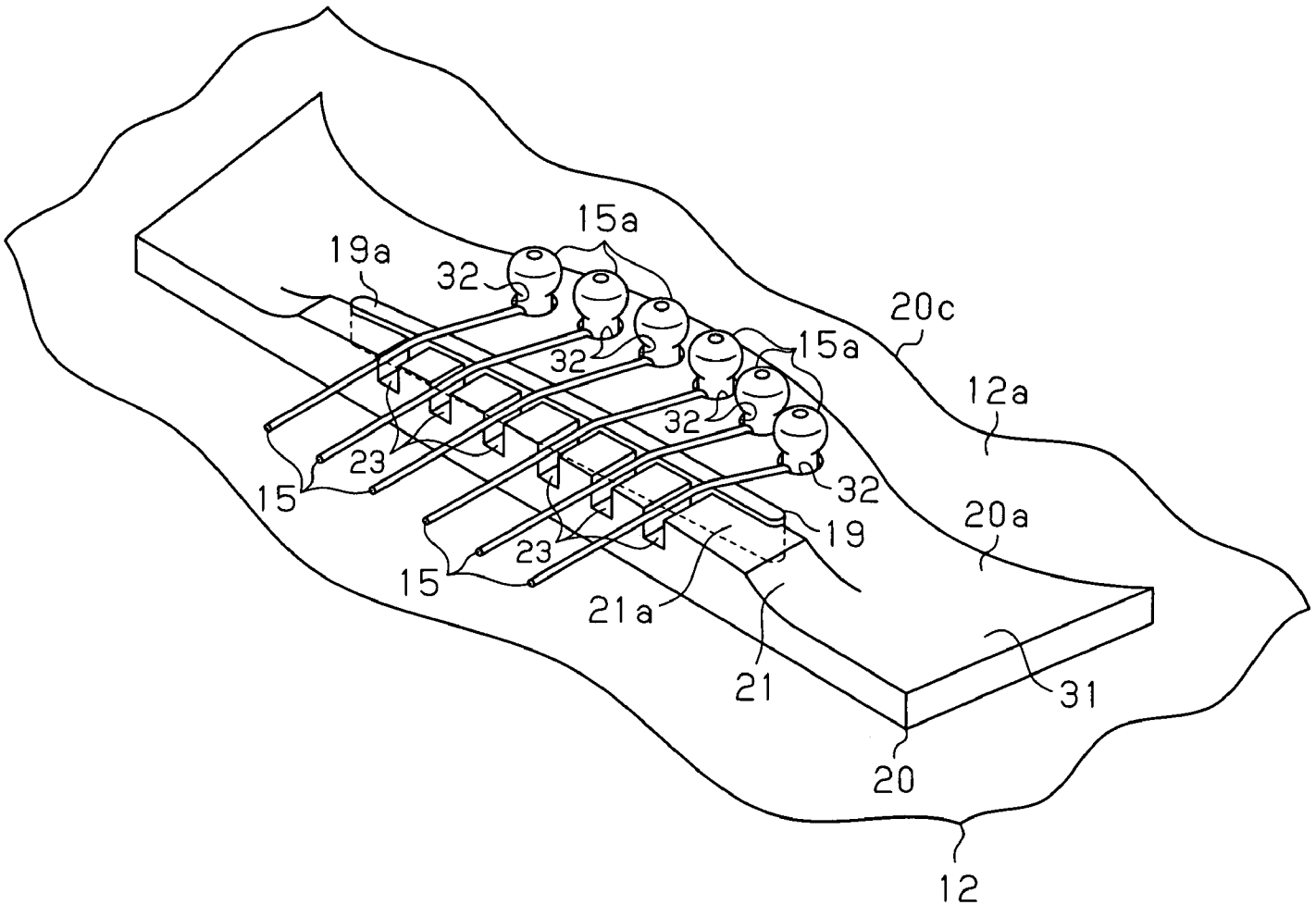
FIG. 2 is a perspective view showing a bridge according to a first embodiment of the invention.

As shown in FIGS. 1 and 2, the bridge 20 is formed to be thicker at a portion near the neck 13 than other portions. In the bridge 20 of this embodiment, the thick portion defines a saddle support 21 for supporting the saddle 19 and the other portions form a base 31 fixed to the upper surface 12*a* of the body 12.

The base 31 includes six holes 32 for holding the ends of the strings 15. The holes 32 are formed along a side edge 20*c* of the bridge 20 opposite the side facing toward the neck 13. A catch (not shown) is attached to the end of each string 15. The strings 15 are hooked to the base 31 by pressing stoppers 15*a* into the holes 32 with the catches arranged in the body 12 through the holes 32.

Figure 3:
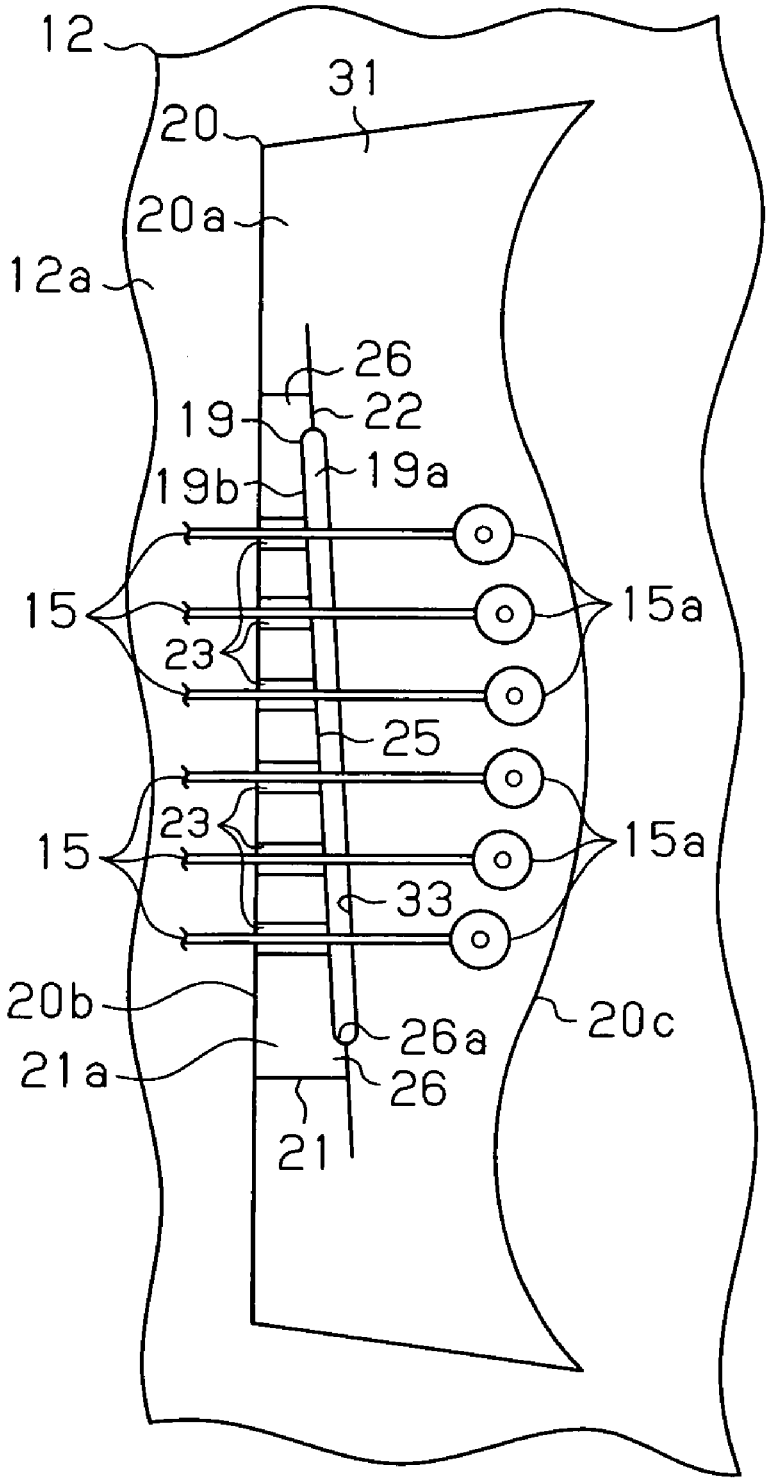
FIG. 3 is a plan view showing the bridge of the first embodiment.
Figure 4:
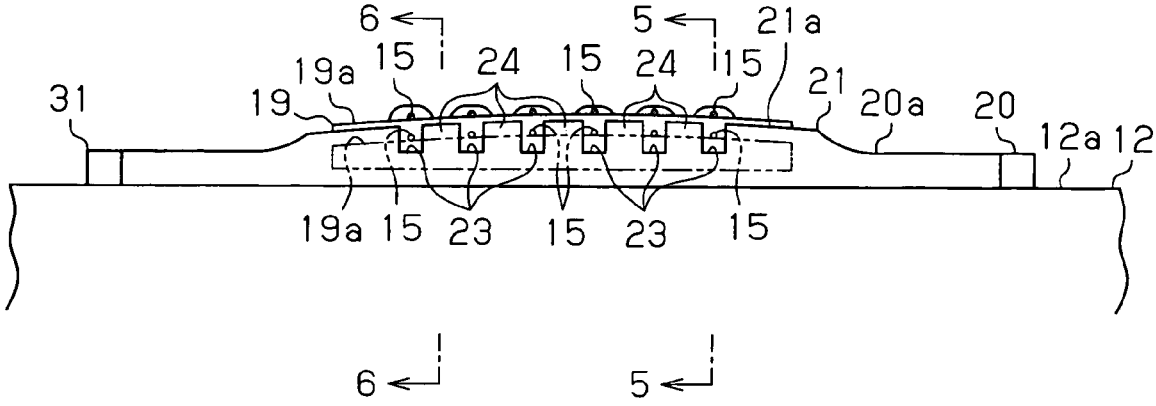
FIG. 4 is a front view showing the bridge of the first embodiment.

As shown in FIGS. 3 and 4, the saddle support 21 includes six grooves 23 extending in the direction of the corresponding strings 15. The grooves 23 serving as string insertion portions are open to an upper surface 21*a* of the saddle support 21.

The grooves 23 are rectangular grooves having rectangular cross-sections and the same width. The depth of the grooves 23 is set in a range from ¼ to ¾ of the height of the saddle support 21, preferably in a range from ⅖ to ⅗ of the height of the saddle support 21. Teeth 24 are formed between adjacent grooves 23 in the saddle support 21. In this first embodiment, the saddle support 21 has five teeth 24.

Figure 5:
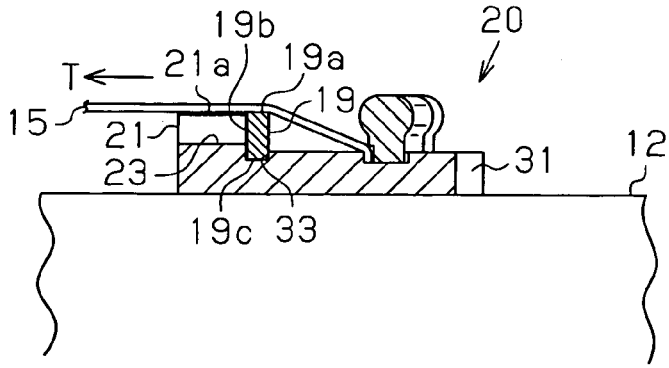
FIG. 5 is a cross-sectional view taken along line 5-5 in FIG. 4.
Figure 6:
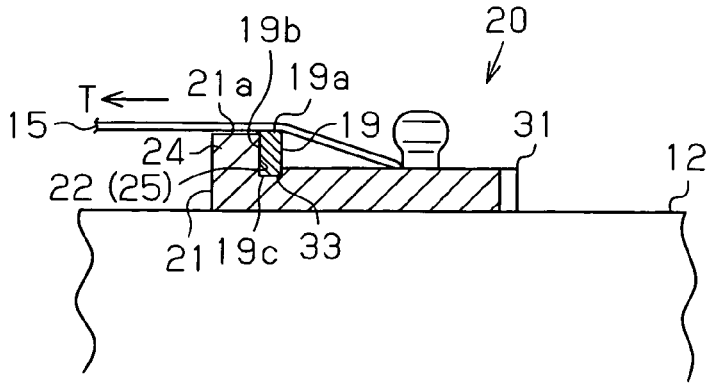
FIG. 6 is a cross-sectional view taken along line 6-6 in FIG. 4.

As shown in FIGS. 3, 5 and 6, the base 31 has an engagement groove 33 formed at the basal end of the saddle support 21 to receive the lower end 19*c* of the saddle 19. The engagement groove 33 extends in a direction intersecting the strings 15. The engagement groove 33 has a dimension in the longitudinal direction set to be the same as the total length of a support recess 25. The depth of the engagement groove 33 is set to be less than one half the thickness of the base 31.

The support recess 25 is formed in the saddle support 21 so that the side of the saddle 19 closer to the neck 13 is fitted into the support recess 25. The longitudinal dimension of the support recess 25 is set to be slightly greater than the total length of the saddle 19. The depth of the support recess 25 is set to be in a range from ¼ to ¾ the thickness of the saddle 19, preferably in a range of ⅖ to ⅗ the height of the saddle support 21. The saddle support 21 further has guides 26 for guiding the two ends of the saddle 19. The inner surface 26*a* of each guide 26 is formed to have a smoothly curved surface like the two ends of the saddle 19.

In a state in which the saddle 19 is mounted on the bridge 20, the lower end 19*c* of the saddle 19 is fitted in the engagement groove 33, and the two ends of the saddle 19 are engaged with guides 26, while substantially half the thickness of the saddle 19 is located in the support recess 25. In this state, the side surface 19*b* of the saddle 19 closer to the neck 13 is engaged with a support surface 22 of the saddle support 21, and the upper surface 19*a* of the saddle 19 is located at least above the bottom of the grooves 23.

The operation of the bridge 20 of the first embodiment will now be discussed.

Figure 14:
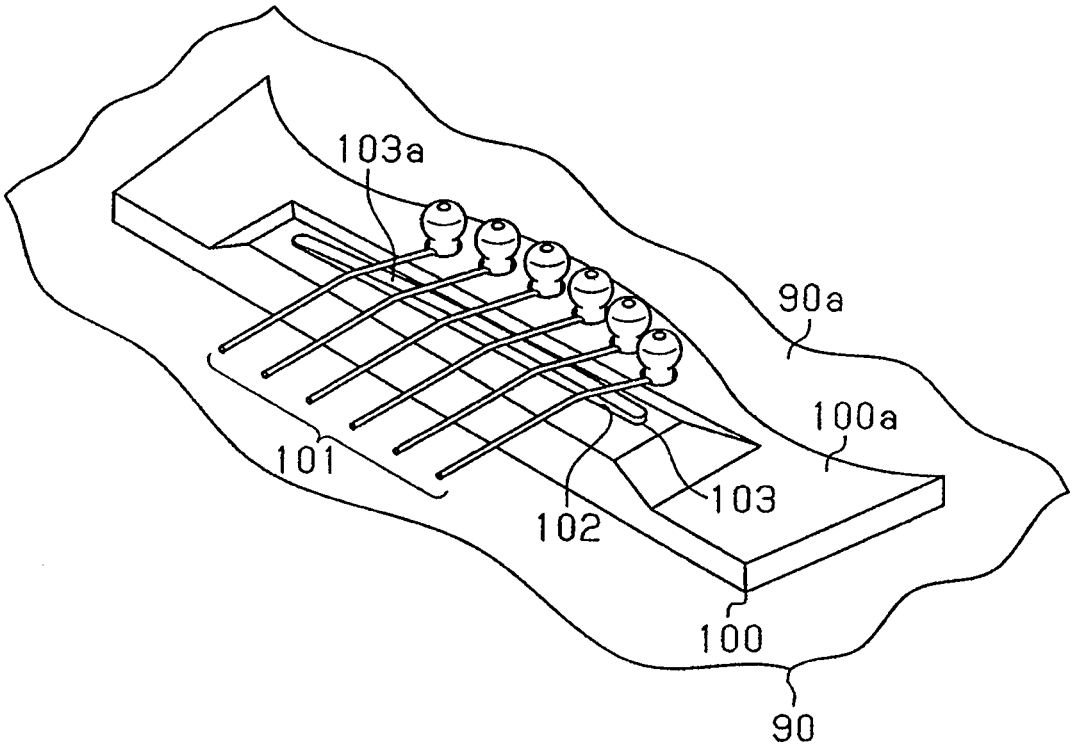
Fig.14 PRIOR ART
FIG. 14 is a perspective view showing a bridge of the prior art.
Figure 15:
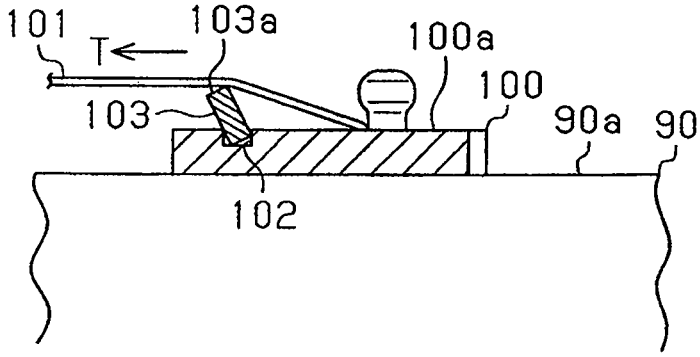
Fig.15 PRIOR ART
FIG. 15 is a schematic diagram showing the saddle in a state tilted on the bridge.

In the bridge 100 of the prior art shown in FIG. 14, the saddle 103 is supported with the contact surface 103*a* protruding from the upper surface 100*a* of the bridge 100. In this case, the edge of the saddle 103 is scraped to correct changes in the string height resulting from dimensional changes that occur in the neck 13 as time elapses. However, as the saddle 103 becomes flush with the upper surface 100*a* of the bridge 100, the bridge 100 will not be able to support the strings 101 in a manner enabling vibration of the strings 101.

In the bridge 20 of the first embodiment, as shown in FIGS. 3 to 6, the saddle support 21 has six grooves 23 extending in the direction of the corresponding strings 15. The saddle 19 is supported by the bridge 20 with the side surface 19*b* that is closer to the neck 13 being in close contact with the support surface 22 of the saddle support 21, and with the lower end 19*c* of the saddle 19 being fitted in the engagement groove 33. In this state, the upper surface 19*a* of the saddle 19 protrudes from the upper surface 21*a* of the saddle support 21.

In the bridge 20 of this embodiment, even if the end surface of the saddle 19 is scraped to adjust the height of the saddle 19, as shown by the double-dashed line in FIG. 4, and the height of the saddle 19 becomes lower than the upper surface 21*a* of the saddle support 21, the strings 15 are still supported by the upper surface 19*a* of the saddle 19 while being accommodated in the corresponding grooves 23 without interfering with the saddle support 21. This increases the scraping margin of the saddle 19 and enables the height of the saddle 19 in a wider range. Consequently, changes in the string height due to dimensional changes that occur in guitar parts as time elapses are more effectively coped with than with the prior art stringed instrument saddle.

When the strings 15 are stretched, the saddle 19 is constantly pulled towards the neck 13 (in the direction indicated by arrow T in FIGS. 5 and 6) by friction between the upper surface 19*a* and the strings 15. In the bridge 20 of this embodiment, the saddle support 21 has the teeth 24, which are formed between the adjacent grooves 23. Only the lower end 19*c* of the saddle 19 is fitted in the engagement groove 33, and the side surface 19*b* of the saddle 19 is in close contact with the support surface 22 of the saddle support 21. Thus, unlike the prior art bridge in which the saddle 19 is supported only at two ends, the entire saddle 19 is uniformly supported by the comb-shaped saddle support 21.

The first embodiment has the advantages described below.

(1) The saddle support 21 includes six grooves 23 extending in the direction of the corresponding strings 15. This ensures that the saddle 19 is prevented from being tilted by the tension of the strings 15, while ensuring a sufficient height adjustment range for the saddle 19. Therefore, changes in the string height due to dimensional changes occurring in the neck 13 or the body 12 as time elapses are coped with. Additionally, the appearance of the conventional bridge remains substantially the same, and the aesthetic appearance of the guitar 11 is not significantly changed.

(2) The support recess 25 is formed in the support surface 22 of the saddle support 21 so that the saddle 19 is supported in a state fitted in the support recess 25. This further effectively prevents the saddle 19 from being tilted by the tension of the strings 15. Thus, the saddle 19 supported by the bridge 20 is kept in a desirable posture. Further, when the saddle 19 is removed from the bridge 20 to adjust the string height, the saddle 19 may easily be remounted on the bridge 20.

(3) The saddle support 21 includes the guides 26 for guiding the opposite ends of the saddle 19. This prevents the saddle 19 from being displaced in the longitudinal direction. Accordingly, the saddle 19 supported by the bridge 20 is kept in a satisfactory state. In addition, the mounting of the saddle 19 to the bridge 20 is further facilitated.

(4) The engagement groove 33 is formed in the base 31 at the basal end of the saddle support 21 so that the lower end 19*c* of the saddle 19 is fitted in the engagement groove 33. This further keeps the saddle 19 supported by the bridge 2 in a satisfactory posture. Further, the mounting of the saddle 19 to the bridge 20 is facilitated.

Second Embodiment

A second embodiment of the present invention will now be described with reference to FIGS. 7 to 11. Parts similar to those of the first embodiment are given the same reference numerals and will not be described in detail.

Figure 7:
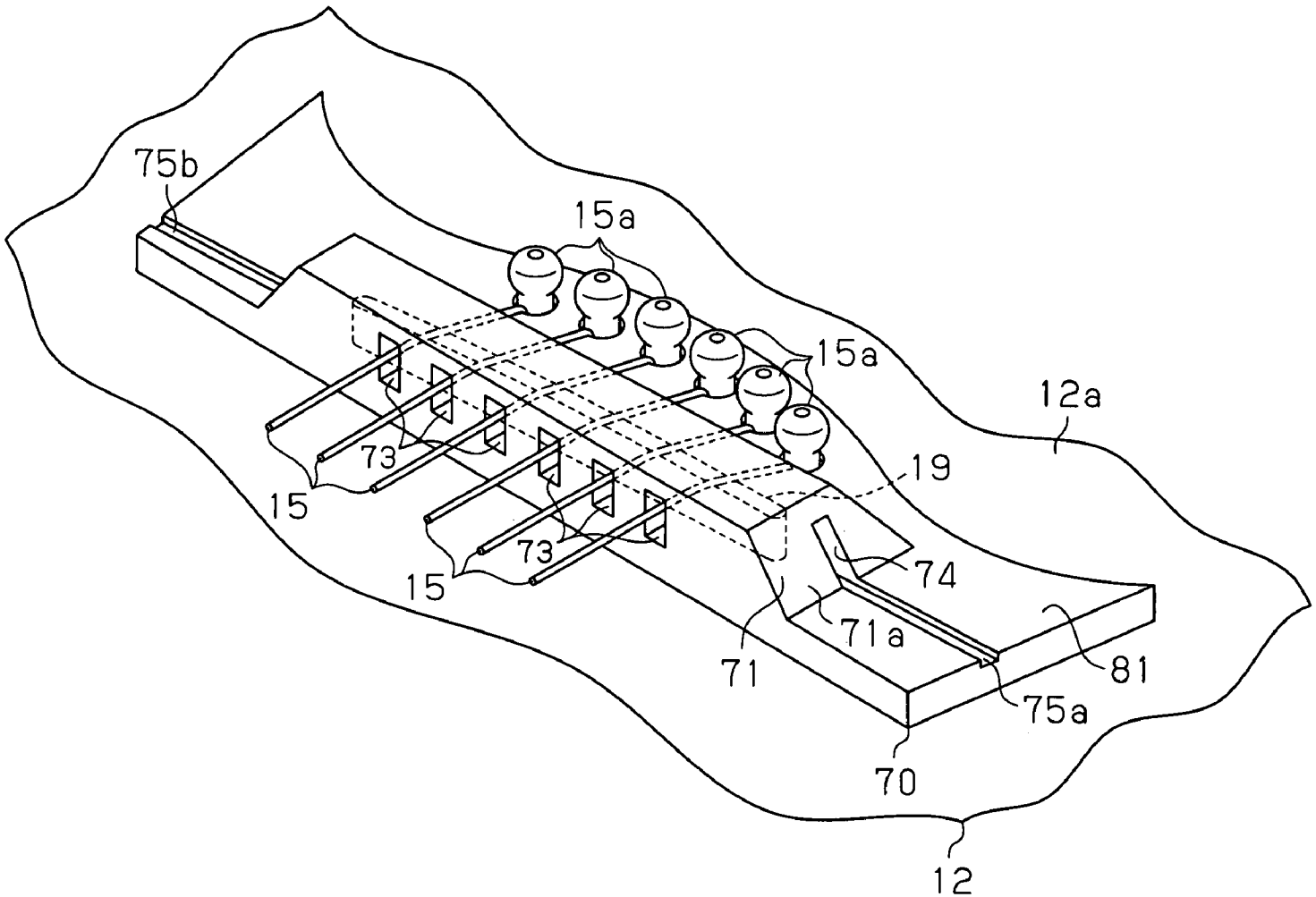
FIG. 7 is a perspective view showing a bridge according to a second embodiment of the invention.

As shown in FIG. 7, a bridge 70 has a protruding portion that is formed to be thicker than that in the first embodiment. In the bridge 70 of the second embodiment, the thick portion serves as a saddle support 71 for supporting the saddle 19, while the other portions forms a base 81 fixed to the body 12.

Figure 8:
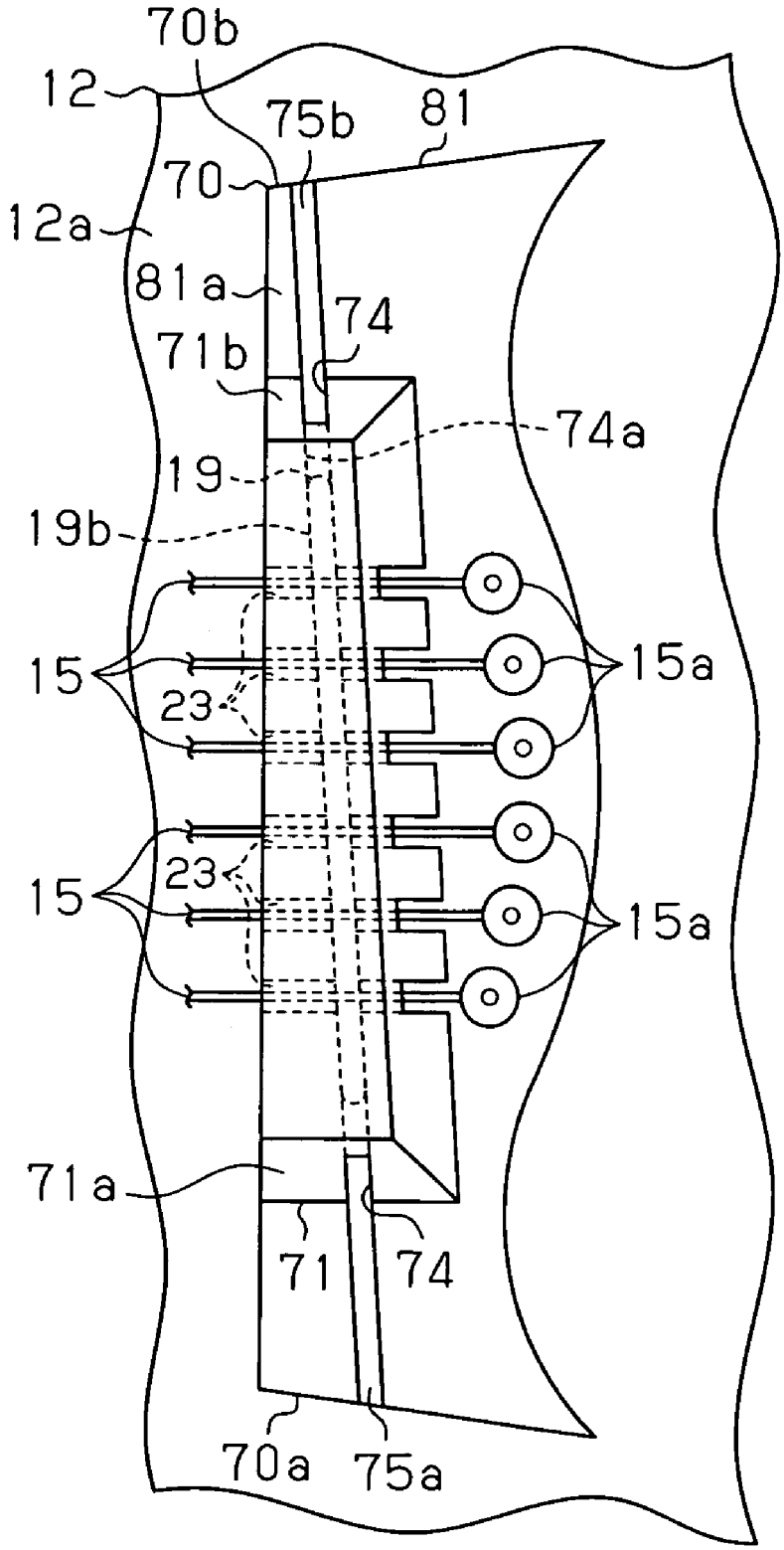
FIG. 8 is a plan view showing a bridge of the second embodiment.
Figure 9:
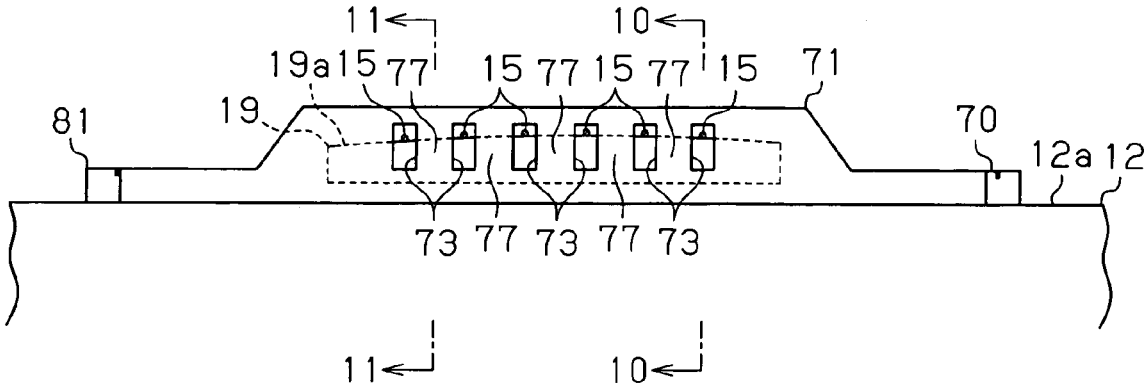
FIG. 9 is a front view showing the bridge of the second embodiment.
Figure 10:
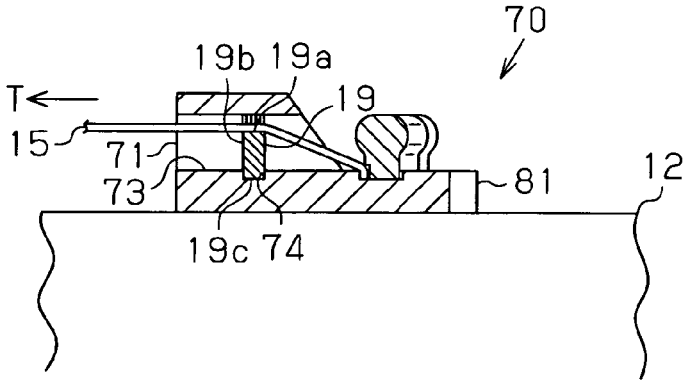
FIG. 10 is a cross-sectional view taken along line 10-10 in FIG. 9.
Figure 11:
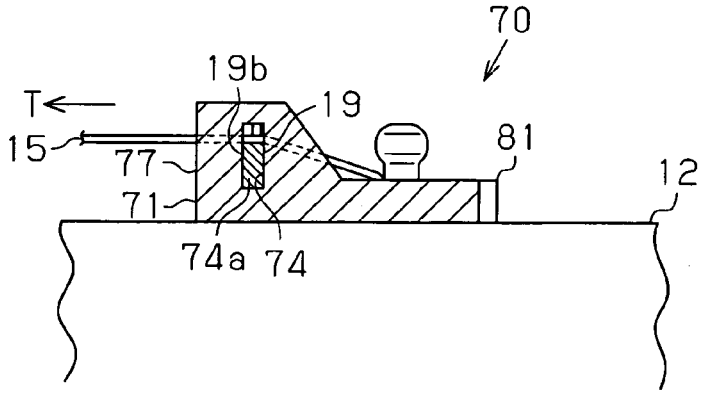
FIG. 11 is a cross-sectional view taken along line 11-11 in FIG. 9.

As shown in FIGS. 8 and 9, the saddle support 71 includes six through holes 73 extending in the direction of the corresponding strings 15. The through holes 73, serving as string insertion portions, are formed substantially in the middle part of the saddle support 71 with respect to the heightwise direction. The through holes 73 are all rectangular holes elongated in the vertical direction and have the same cross-sectional shape.

As shown in FIGS. 7 to 9, the saddle support 71 has a saddle accommodation hole 74 for accommodating the saddle 19. The saddle support 71 intersects the through holes 73. The saddle accommodation hole 74 opens at two end faces 71*a* and 71*b* of the saddle support 71 in the longitudinal direction. The width of the saddle accommodation hole 74 is set slightly greater than the width of the saddle 19. In this embodiment, the inner surface 74*a* of the saddle accommodation hole 74 that is closer to the neck 13 functions as a support surface for supporting the side surface 19*b* of the saddle 19 that is closer to the neck 13.

Two slide grooves 75*a* and 75*b* are formed in the upper surface 81*a* of the base 81 along extensions of the saddle accommodation hole 74. The width of the slide grooves 75*a* and 75*b* are set to be the same as the width of the saddle accommodation hole 74. The slide grooves 75*a* and 75*b* extend from the saddle accommodation hole 74 in the saddle support 71 to the outer edges 70*a* and 70*b* of the bridge 70, respectively.

In the bridge 70 of the second embodiment, as shown in FIGS. 8 to 11, the saddle support 71 has the six through holes 73, which extend in the direction of the corresponding strings 15, and the saddle accommodation hole 74, which intersects the through holes 73. The saddle 19 is supported by the saddle support 71 in a state inserted into the saddle accommodation hole 74. In this state, the upper surface 19*a* of the saddle 19 is located in the through holes 73 of the saddle support 71.

The strings 15 are supported in a manner enabling vibration by the upper surface 19*a* of the saddle 19 in the corresponding through holes 73 without interfering with the saddle support 71. In the same manner as in the first embodiment, the scraping margin of the saddle 19 may be increased so as to increase the height adjustment range of the saddle 19. Thus, the saddle of the second embodiment may sufficiently cope with changes in the string height due to dimensional changes that occur in guitar parts as time elapses more effectively than prior art stringed instrument saddles.

When the strings 15 are arranged in a tensioned state, the saddle 19 is constantly pulled towards the neck 13 (in the direction indicated by arrow T in FIGS. 10 and 11) by friction between the upper surface 19*a* and the strings 15. In the bridge 70 of this embodiment, the saddle 19 is supported by the saddle support 71 in a state accommodated in the saddle accommodation hole 74. In this state, the side surface 19*b* of the saddle 19 closer to the neck 13 is in close contact with the inner surface 74*a* of the saddle accommodation hole 74. In the same manner as in the first embodiment, in the second embodiment, the entire saddle 19 is uniformly supported by the saddle support 71, which is hollow.

The second embodiment has the advantages described below.

(5) The saddle support 71 has six through holes 73 extending in the direction of the strings 15 and the saddle accommodation hole 74 intersecting with the through holes 73. This prevents the saddle 19 from being tilted by the tension of the strings 15, while ensuring a sufficient height adjustment range for the saddle 19. Accordingly, changes in the string height due to dimensional changes in the neck 13 as time elapses may be coped with. Additionally, the appearance of the conventional bridge remains substantially the same, and the aesthetic appearance of the guitar 11 is not significantly changed.

(6) The through holes 73 are formed in substantially the middle of the saddle support 71 with respect to the heightwise direction. Thus, the through holes 73 formed in the saddle support 71 may have a larger dimension in the heightwise direction. Accordingly, the scraping margin of the saddle 19 may be increased and the height adjustment range of the saddle 19 may be increased.

(7) The saddle accommodation hole 74 opens at the two end faces 71*a* and 71*b* of the saddle support 71 in the longitudinal direction. This facilitates insertion of the saddle 19 into the saddle accommodation hole 74 from one of the two end faces 71*a* and 71*b* of the saddle support 71. Accordingly, the second embodiment of the invention provides a stringed instrument bridge with high convenience.

(8) The two slide grooves 75*a* and 75*b* are formed on the upper surface 81*a* of the base 81 and arranged along the extension of the saddle accommodation hole 74. This enables smooth insertion of the saddle 19 into the saddle accommodation hole 74 through one of the slide grooves 75*a* and 75*b*. Thus, the convenience of the stringed instrument bridge is further improved.

The first and second embodiments described above may be modified as follows.

Figure 12:
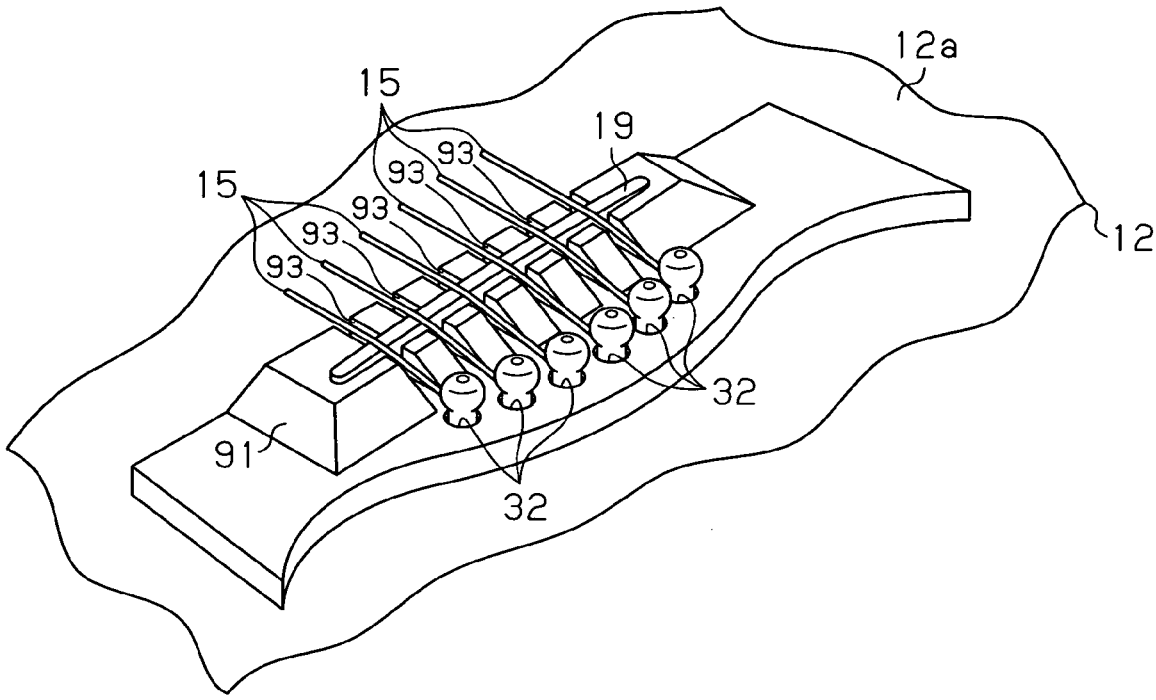
FIG. 12 is a perspective view showing a modification of the bridge.
Figure 13:
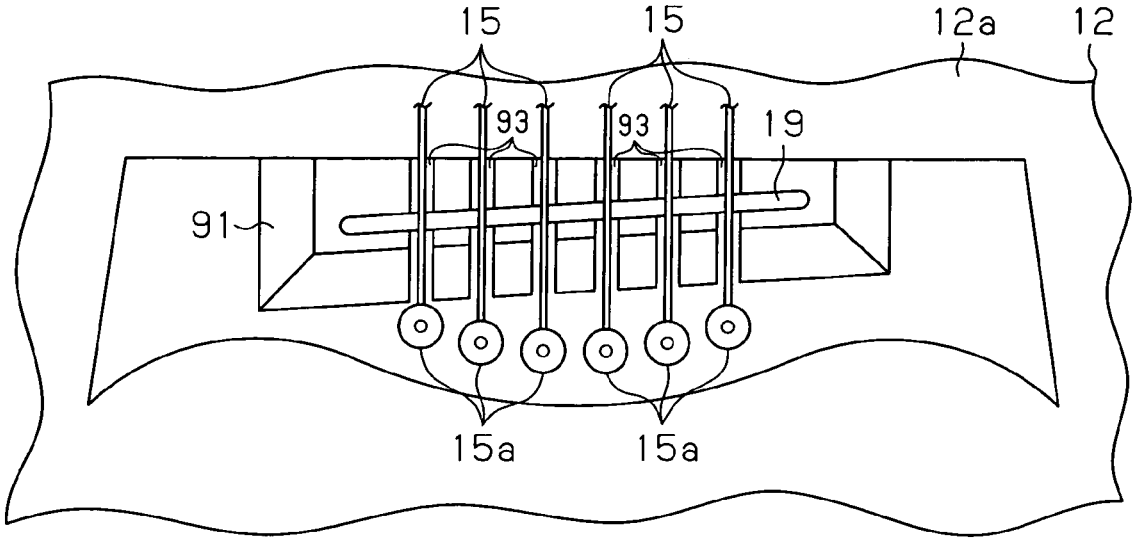
FIG. 13 is a plan view showing the modification of the bridge.

In the first embodiment, the saddle support 21 may be replaced with a saddle support 91 shown in FIGS. 12 and 13. In this case, the saddle support 91 and grooves 93 extend to the vicinity of the holes 32 holding the strings 15. This prevents the saddle 19 from being tilted by the tension of the strings 15, while ensuring a large height adjustment range for the saddle 19.

In the first embodiment, the support recess 25 for supporting the side surface 19*b* of the saddle 19 near the neck 13 may be omitted from the saddle support 21.

In the first embodiment, the guides 26 for guiding the two ends of the saddle 19 may be omitted from the saddle support 21.

In the first embodiment, the grooves 23 are all rectangular grooves. However, the shape of the grooves 23 may be changed to any shape. Additionally, although the number of the grooves 23 is six in the first embodiment, the number of the grooves 23 may be changed as required in accordance with the number of the strings 15.

In the second embodiment, the positions of the through holes 73 may be changed to positions offset upwards from the substantially middle part of the saddle support 71 with respect to the heightwise direction.

In the second embodiment, the saddle accommodation hole 74 may be open in only one of the two end faces 71*a* and 71*b* of the saddle support 71 in the longitudinal direction.

In the second embodiment, one of the two slide grooves 75*a* and 75*b* formed in the upper surface 81*a* of the base 81 may be omitted.

In the second embodiment, the through holes 73 are all rectangular holes. However, the shape of the through holes 73 may be changed to any desired shape. Although the number of the through holes 73 is six in the second embodiment, the number of the through holes 73 may be changed as required in accordance with the number of the strings 15.

Although the bridges 20 and 70 are applied to an acoustic guitar in the first and second embodiments, they may be applied to any other stringed instrument other than guitars.

What is claimed is:

1. A stringed instrument bridge for supporting a plurality of strings with a saddle on a body of a stringed instrument having a neck, which extends from the body, in a manner enabling vibration of the strings, the stringed instrument bridge comprising:

a base fixed to the body, the base being formed into a plate and extending in a direction perpendicular to and across a direction of extension of the strings;

a unitary saddle set on an upper surface of the base and supporting the plurality of strings, the unitary saddle having one side surface closer to the neck and another side surface farther from the neck;

a saddle support arranged on the base to support the saddle; and a support surface upstanding from the base, and arranged on the saddle support to support the side surface of the unitary saddle closer to the neck, operative to resist tilting of the unitary saddle by tension in the strings;

the saddle support having a plurality of string insertion portions extending in the direction of the corresponding strings, the string insertion portions being arranged closer to the neck than the saddle is; and the strings being supported by the upper surface of the saddle in corresponding string insertion portions the string insertion portions are grooves that open in the upper surface of the saddle support; and the support surface including a support recess for supporting the saddle with the saddle fitted in the support recess.

2. The stringed instrument bridge according to claim 1, wherein each of the grooves has a depth set in a range from ¼ to ¾ the height of the saddle support.

3. The stringed instrument bridge according to claim 1, wherein the saddle support includes teeth formed between adjacent grooves.

4. The stringed instrument bridge according to claim 1, wherein the support recess has a depth set in a range of ¼ to ¾ the thickness of the saddle.

5. The stringed instrument bridge according to claim 1, wherein the saddle support has guides for guiding two ends of the saddle in a longitudinal direction of the saddle support.

6. The stringed instrument bridge according to claim 5, wherein the guides have inner surfaces formed into the same shape as the two ends of the saddle.

7. A stringed instrument bridge for supporting a plurality of strings with a saddle on a body of a stringed instrument having a neck, which extends from the body, in a manner enabling vibration of the strings, the stringed instrument bridge comprising:

a base fixed to the body, the base being formed into a plate and extending in a direction perpendicular to and across a direction of extension of the strings;

a unitary saddle set on an upper surface of the base and supporting the plurality of strings, the unitary saddle having one side surface closer to the neck and another side surface farther from the neck;

a saddle support arranged on the base to support the saddle;

a support surface upstanding from the base, and arranged on the saddle support to support the side surface of the unitary saddle closer to the neck, operative to resist tilting of the unitary saddle by tension in the strings;

an engagement groove formed in the base at a basal end of the saddle support so that a lower end of the saddle is fitted in the engagement groove;

the saddle support having a plurality of string insertion portions extending in the direction of the corresponding strings, the string insertion portions being arranged closer to the neck than the saddle is;

the strings being supported by the upper surface of the saddle in corresponding string insertion portions; and the string insertion portions are grooves that open in the upper surface of the saddle support.

8. The stringed instrument bridge according to claim 7, wherein the engagement groove has a depth set to less than one half the thickness of the base.

* * * * *